United States Patent [19]

Hubbard et al.

[11] Patent Number: 4,673,084

[45] Date of Patent: Jun. 16, 1987

[54] CONTAINER FOR DISPENSING SURGICAL MASKS

[75] Inventors: Vance M. Hubbard; Welton K. Brunson, both of Bedford, Tex.

[73] Assignee: Tecnol, Inc., Fort Worth, Tex.

[21] Appl. No.: 778,881

[22] Filed: Sep. 23, 1985

[51] Int. Cl.[4] ..... B65D 85/24

[52] U.S. Cl. ..... 206/438; 206/278; 206/440

[58] Field of Search ..... 206/438, 213, 278, 440, 206/441, 205, 278, 503, 297; 128/139

[56] References Cited

U.S. PATENT DOCUMENTS

| | | | |
|---|---|---|---|
| 703,627 | 7/1902 | Utermohlen | 206/440 |
| 1,671,825 | 5/1928 | Johnson | 206/440 |
| 2,712,313 | 7/1955 | Levy | 206/440 |
| 3,247,957 | 4/1966 | Kemble | 206/440 |
| 4,269,315 | 5/1981 | Boyce | 206/438 |

*Primary Examiner*—Joseph Man-Fu Moy

*Attorney, Agent, or Firm*—Jerry W. Mills; Roger N. Chauza

[57] ABSTRACT

A container (12) is disclosed for storing and dispensing surgical face masks (14). A divider (24) with an opening (47) is insertable into the container (12) for dividing it into two compartments (26, 28). The face panels of the masks (14) are stacked in one compartment (26), and the tie strings (30) are routed through the divider opening (47) into the other compartment (28). The divider (24) includes a pair of interlocking flaps (56, 58) which are engageable with folding flaps (34, 36) of the container, thereby locking the divider (24) in a desired position within the container (12).

8 Claims, 6 Drawing Figures

FIG. 1
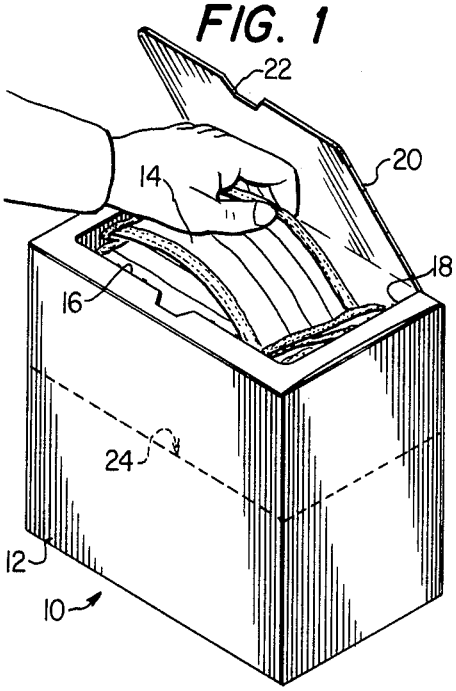
FIG. 3
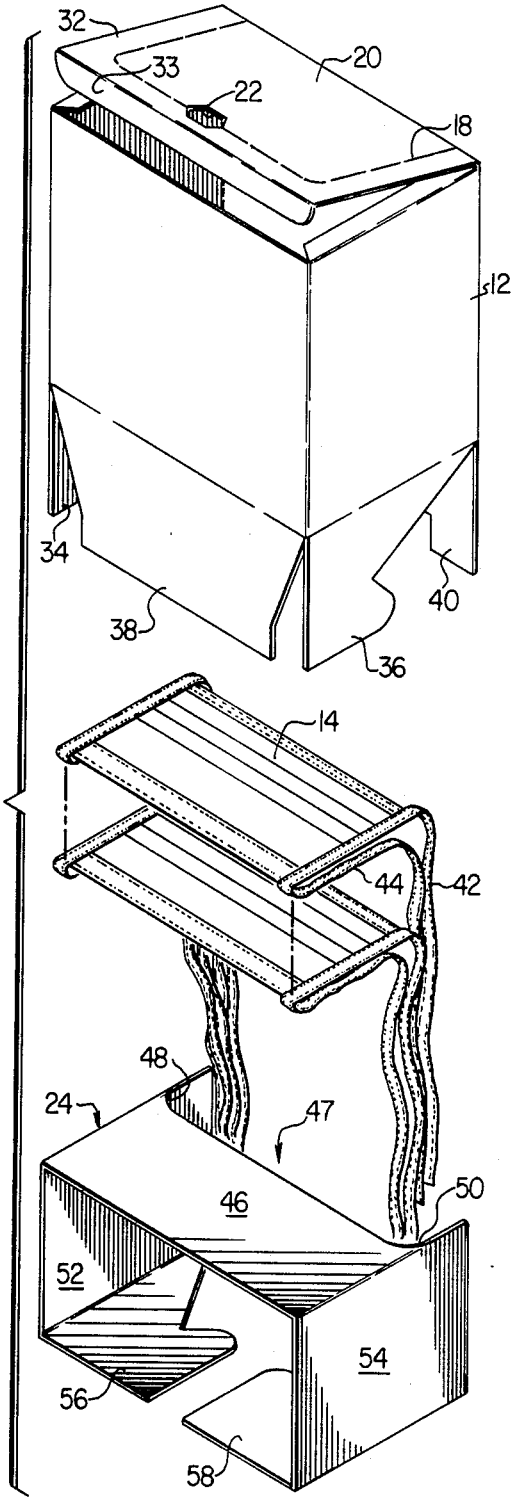
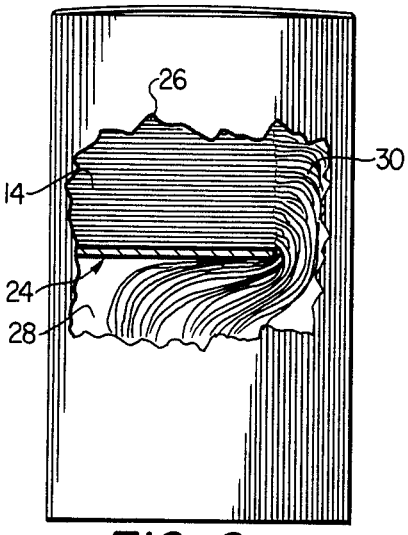
FIG. 2

FIG. 4
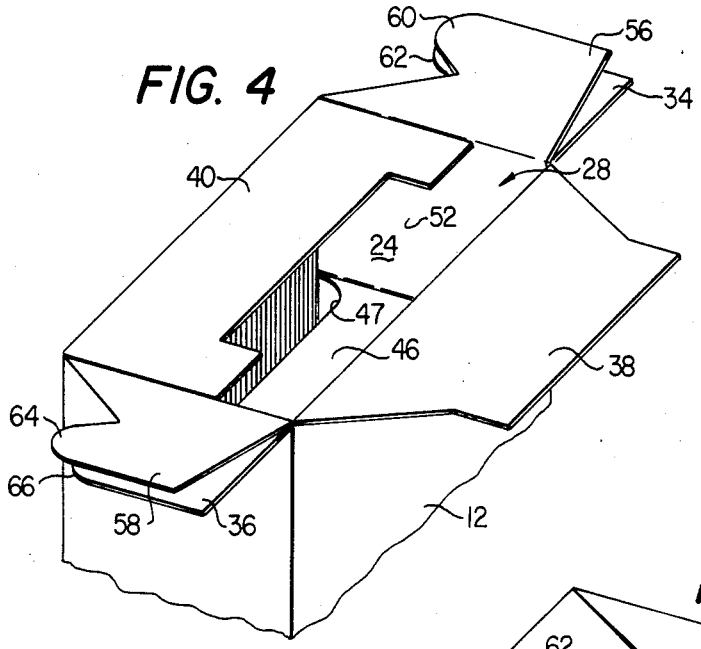
FIG. 5
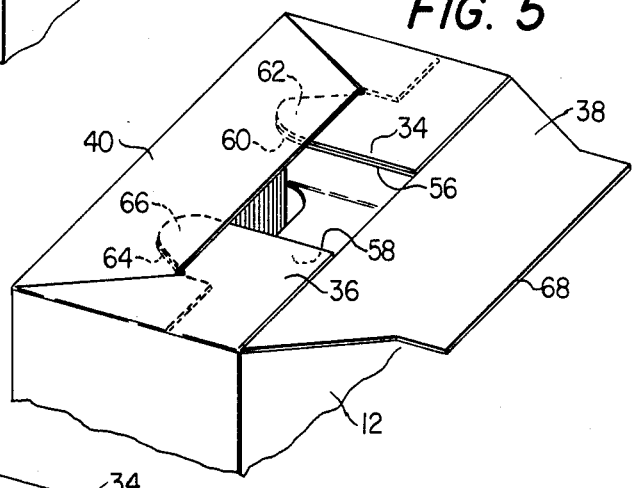
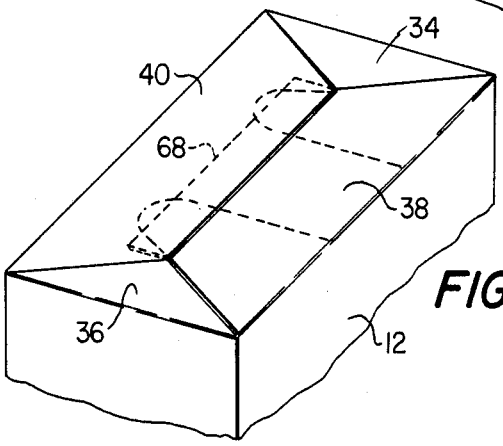
FIG. 6

CONTAINER FOR DISPENSING SURGICAL MASKS

TECHNICAL FIELD OF THE INVENTION

The present invention relates in general to containers, and more particularly to a method and apparatus for storing and dispensing surgical masks.

BACKGROUND OF THE INVENTION

Disposable surgical masks for hospital use are commonly fabricated from inexpensive paper or fabric to enable disposal after use. Surgical masks generally include a flat, rectangular panel which covers the face of the wearer, with four ties or strings attached by stitching or heat sealings to the corners of the rectangular panel. The masks are generally sold and stored in groups, and are removed one by one for use.

Heretofore, surgical mask dispensers have allowed dispensing only at a relatively high cost. In order to keep the mask ties from becoming entangled during storage and dispensing, the ties of each mask were required to be individually folded over the rectangular portion before stacking the folded masks in a dispensing box. Such folding is generally required to be done by hand, thereby incurring added manufacturing costs. Were the masks not individually folded, the removal of one mask could result in the inadvertent removal of several masks due to their entangled tie straps. As a result, many masks were either wasted or contaminated.

Hospitals are currently faced with the need to reduce costs and with the need to increase sanitary conditions. A need has thus arisen for a surgical mask storage container and dispenser which eliminates the requirement to individually fold each mask and associated strings, but still allows tangle-free removal of the masks from the dispenser.

SUMMARY OF THE INVENTION

In accordance with the present invention, a container for storing and dispensing surgical masks is provided which substantially reduces or eliminates the shortcomings previously associated with prior dispensing techniques.

In accordance with the present invention, an open-topped dispensing container includes an interior with a divider which forms an upper and a lower compartment within the container. The flat rectangular panels of the masks are oriented in a stacked configuration and deposited in the upper compartment. The bundle of ties attached to the stack of masks are routed over the divider and into the lower compartment. The masks can then be individually removed from the open top of the container without becoming tangled with adjacent masks.

In accordance with yet another aspect of the invention, the divider includes two side flaps which interlock with container flaps to fix the divider in a desired location therein.

In further accordance with the present invention, a method of stacking the surgical masks includes arranging the mask ties such that all the ties protrude from the same side of the stack and are stored in a compartment separate from the rectangular mask panels.

BRIEF DESCRIPTION OF THE DRAWINGS

For a detailed description of the present invention and for further objects and advantages thereof, reference is now made to the following description taken in conjunction with the accompanying drawings, in which:

FIG. 1 is a perspective view of the invention during use;

FIG. 2 is a cut-away side view showing the relationship of the container interior, the masks, the divider, and the routing of the ties;

FIG. 3 shows an exploded view of the container, surgical masks, and the divider of the invention; and FIGS. 4–6 are perspective views of the container bottom, showing the various flap folding steps for closing the container and fixing the divider therein.

DETAILED DESCRIPTION OF THE INVENTION

FIG. 1 is a perspective view of the surgical mask dispenser in accordance with the present invention, and is generally identified by reference character 10. The dispenser 10 includes a rectangular container or box 12 for storing the disposable surgical masks 14. The upper portion of the container 12 includes a dispensing aperture 16, the peripheral edge of which is defined by perforations 18. When torn around the perforations 18 an aperture flap 20 is formed, and is hinged at the back edge of the container top. A finger hole 22 is provided for grasping the aperture flap 20 and tearing the perforations 18, thereby forming aperture 16. As illustrated, a plurality of diposable surgical masks 14 are stored in container 12 for sequential removal through aperture 16.

FIG. 2 is a cut-away side view of the storage and dispenser container according to the present invention. A divider 24 is provided for separating the container into two compartments, namely, an upper compartment 26 and a lower compartment 28. For reasons of economy, the divider 24 is constructed of the same material as the container 12, and preferably of a stiff cardboard. The stacked panels of the masks 14 are stored in the upper compartment 26. The mask ties, generally identified by reference character 30, are routed from the upper compartment 26 over the divider 24 and into the lower compartment 28.

FIG. 3 is an exploded view of the present invention. In the preferred embodiment, the container 12 has an upper flap 32, with a lip 33, which allows opening and closing the top of the container's 12. The container upper flap 32 includes the finger hole 22, perforations 18 and aperture flap 20. The container 12 also includes four bottom flaps, 34, 36, 38 and 40, which interlock to form the bottom of container 12. To be described in more detail below, the flaps 34 and 36 interlock with parts of the divider 24.

FIG. 3 illustrates the masks 14 and the method of folding thereof, according to the preferred embodiment. The masks 14 have two upper ties 42 and two lower ties 44. As shown in FIG. 3, both the upper tie 42 and lower tie 44 on the same edge of the mask 14 may be part of a single strip of material attached to the side thereof. Each mask 14 in the stack is folded such that its two lower ties 44 are folded upward along the side of the mask 14 so as to align with the upper ties 42. This stacking arrangement facilitates automatic folding and stacking the masks 14.

FIG. 3 also depicts the preferred embodiment of the shape of the container divider 24. The divider 24 is dimensioned such that it fits within the container 12.

Three sides of the divider 24 fit flush with the sides of the container 12. The remaining non-flush side 46 is cut so as to form an opening 47 between the upper compartment 26 and the lower compartment 28. Although the non-flush side 46 of the divider 24 is illustrated as creating a single rectangular opening 47 with rounded corners 48 and 50, such side could also be designed to form a plurality of openings, or form openings of other shapes.

The divider 24 includes two side sections 52 and 54 described above as being flush with the container 12. The side sections 52 and 54 are of such length as to position the non-flush side 46 of the divider 24 in a desired location within container 12. Each side section is connected by a fold to an interlocking flap 56 and 58 respectively. The interlocking flaps 56 and 58 correspond to similar shaped flaps 34 and 36 on the bottom of the container 12.

With reference to FIGS. 4–6 there are shown the steps for folding the container bottom flaps, together with those of the divider 24, such that the container bottom is closed and the divider 24 is fixed therein. For clarity, the dispenser 10 is shown without face masks. However, it should be understood that when assembling the dispenser 10, the panels of the masks would be folded together and placed on the top side of divider section 46, with the bundle of ties 30 routed through opening 47 and placed in the bottom compartment 28 shown in FIG. 4. As noted in the figure, when the divider 24 is correctly placed within the container 12, cusped flap 36 of the container is aligned with cusped flap 58 of the divider. Container and divider cusped flaps 34 and 56 are comparably aligned. Next, the bottom notched container flap 40 is folded inwardly as shown.

As illustrated in FIG. 5, all four cusped flaps 34, 36, 56, 58 are folded inwardly, and the ears 60, 62, 64, 66 thereof are directed under the bottom notched flap 40. The bottom notched flap 40 thus being disposed over the ears of all four cusped flaps and under the diagonal parts of such flaps, establish a locking engagement therebetween. With this arrangement, the movement of the divider 24 within the container 12 is prevented.

Lastly, the container's bottom flap 38 shown in FIG. 6 is folded inwardly, and the tab 68 of such flap is forced under the notched edge of flap 40. With this type of locking technique, the dispenser 10 retains a high degree of cubic rigidity, thereby resisting damage due to rough handling.

As illustrated in the FIGURES, there is shown the removal of a single mask 14 from the dispenser 10. Although the aperture 16 is shown facing upwardly, the dispenser 10 may also be oriented such that the aperture 16 faces horizontally outwardly. As the front exposed mask 14 is removed, the ties connected thereto slide through the divider opening 47 from the second chamber 28 to the first chamber 26, and out the aperture 16. The divider 24 prevents the ties from becoming entangled with one another, and thus the removal of the frontal mask will not result in the removal or disturbance of other masks in the stack.

It is thus seen that the present invention discloses a method and device in which the dispensing of masks is substantially improved. The present invention eliminates the entanglement of masks, yet avoids the high cost of individually folding the masks and associated ties.

Although the preferred embodiments have been described in detail, it should be understood that various changes, substitutions and alterations can be made therein without departing from the spirit and the scope of the invention as defined by the appended claims.

What is claimed is:

1. A dispenser for shipping and dispensing surgical masks of the type having a face panel and attached ties, comprising:

a container for holding a plurality of the surgical masks oriented in a stacked configuration, said container having a dispensing aperture for enabling removal of the masks from said container;

dividing means for separating said container into first and second compartments, said first compartment being disposed adjacent said dispensing aperture and containing the stacked face panels of the masks;

said dividing means including means for allowing the mask ties to be disposed along one side of said container from said first compartment into said second compartment;

said second compartment being disposed adjacent said first compartment and opposite said dispensing aperture, and said second compartment being dimensioned to contain the ends of the mask ties;

said masks thereby being individually removable from said container through said dispensing aperture without the undesirable removal or entanglement of adjacent masks.

2. The dispenser of claim 1 wherein said dividing means comprises a support surface capable of supporting said stacked configuration of masks, and an opening for routing the mask ties therethrough.

3. The dispenser of claim 2 wherein said container is a box, and said dividing means is disposed in a plane parallel to the side of said box containing said aperture;

said dividing means having a first, second, third, and fourth side;

said first, second, and third sides being disposed adjacent to the walls of said container; and said fourth side being operative to form said first and second compartments and shaped to form an opening therebetween.

4. The dispenser of claim 3 wherein said fourth side is shaped to form a rectangular opening.

5. The dispenser of claim 3 wherein said fourth side creates an opening with arcuate inside corners.

6. The dispenser of claim 2 wherein said dividing means further includes:

a first and second side section flush with said container;

a first and second interlocking flap;

said first interlocking flap being attached to said first side section; and said second interlocking flap being attached to said second side section.

7. The dispenser of claim 6 wherein said first and second interlocking flaps interlock with said container to lock said dividing means in a fixed position within said container.

8. The dispenser of claim 7 wherein said dividing means is positioned such that the volume of said first compartment is substantially equal to the volume of said second compartment.

* * * * *